US006119428A

United States Patent [19]

Gumz

[11] Patent Number: 6,119,428

[45] Date of Patent: Sep. 19, 2000

[54] PROTECTIVE LINER FOR FREEZERS

[76] Inventor: Dale M. Gumz, 602 State St., Cedar Falls, Iowa 50613-3381

[21] Appl. No.: 09/374,773

[22] Filed: Aug. 16, 1999

[51] Int. Cl.[7] ..... E04C 2/42

[52] U.S. Cl. ..... 52/660; 52/676

[58] Field of Search ..... 52/764, 474, 676, 52/660, 799.12, 799.11, 799.13; 428/118

[56] References Cited

U.S. PATENT DOCUMENTS

| | | | |
|---|---|---|---|
| 253,732 | 2/1882 | MacDonald | 52/799.12 |
| 1,053,199 | 2/1913 | Moore | 52/799.12 |
| 2,194,719 | 3/1940 | Parrish . | |
| 2,370,034 | 2/1945 | Haugland . | |
| 2,635,779 | 4/1953 | Pfeiffer . | |
| 3,194,622 | 7/1965 | Harter . | |
| 3,944,111 | 3/1976 | Nonomaque et al. . | |
| 4,127,156 | 11/1978 | Brandt | 160/179 |
| 4,600,619 | 7/1986 | Chee | 428/118 |
| 4,623,951 | 11/1986 | DuPont | 428/118 |
| 5,964,070 | 10/1999 | Redl | 52/581 |

*Primary Examiner*—Carl D. Friedman
*Assistant Examiner*—Kevin McDermott
*Attorney, Agent, or Firm*—James C. Nemmers

[57] ABSTRACT

A removable liner that is positioned on the inside walls of a freezer or freezer compartment. The liner is made of a mesh material of low thermal conductivity and is thick enough so that the skin of an individual using the freezer cannot touch the wall of the freezer. The mesh has openings in it to allow air to circulate through it and therefore not adversely affect the efficiency of the freezer.

7 Claims, 1 Drawing Sheet

FIG. 1
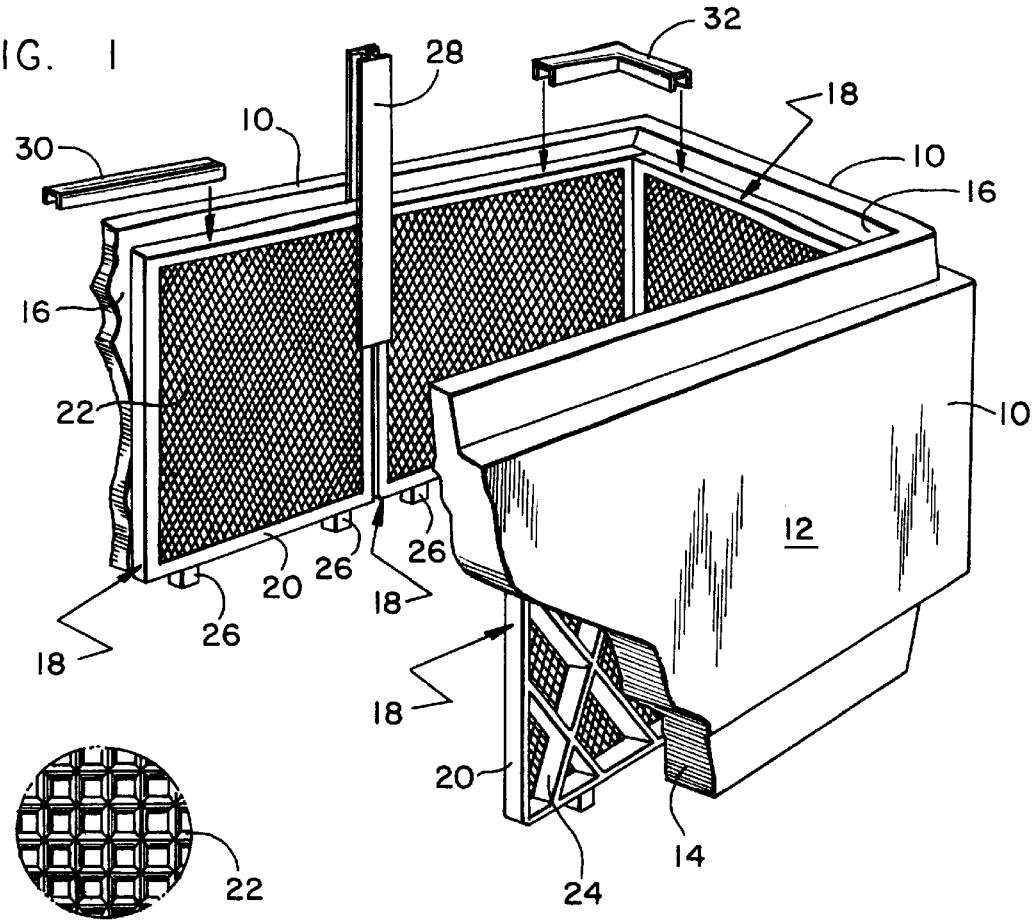
FIG. 3
FIG. 2
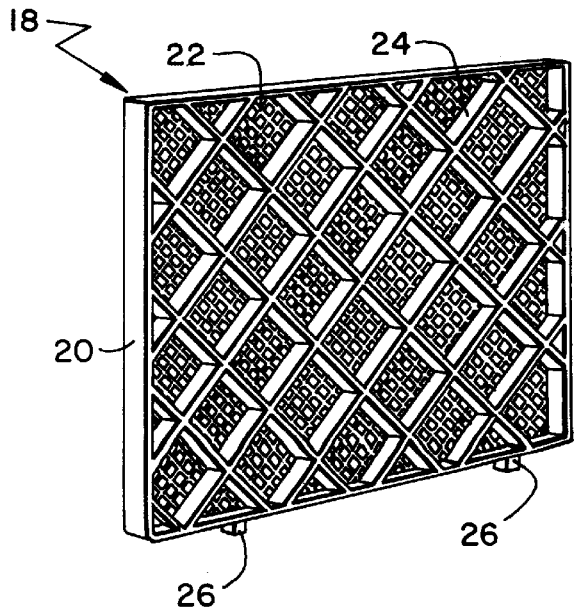
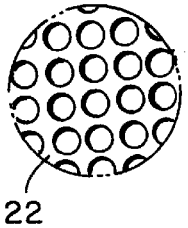
FIG. 4
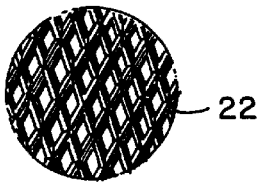
FIG. 5

PROTECTIVE LINER FOR FREEZERS

BACKGROUND OF THE INVENTION

Food freezers and freezer compartments of refrigerators can be hazardous to a person using them if the metal sides of the freezer compartment are inadvertently touched by the person's skin when it is moist. If the person's skin is moist and comes into contact with the inside walls of the freezer compartment, frequently the surface has sufficient thermal conductivity to freeze the liquid moisture and the skin. This can cause injury to the user, and in extreme cases it can be somewhat difficult to pull the skin from the surface without considerable pain and risk of permanent injury.

To the best of the inventor's knowledge, there has been no attempt to solve this problem. Freezers and freezer compartments continue to be made with walls having a high thermal conductivity and a sufficient heat-sink ability to freeze liquid moisture almost instantly. The walls of the freezer compartment are constructed in this way for the most efficient operation of the freezer. However, the problem does exist, and injuries have occurred to persons who are not careful in avoiding contact with the walls of the freezer compartment. This can especially be a hazard with commercial "spot" freezers which have open or closed tops for displaying and dispensing ice cream and other frozen products where children and adults are invited to reach in and pick out those frozen treats for purchase. Also, home freezers and freezer compartments can present a hazard where small children are in the household. There is therefore a need for a solution to avoid injuries from contact of the skin with the freezer walls.

SUMMARY OF THE INVENTION

The invention provides a removable liner that is positioned on the inside walls of the freezer. The liner is made of a mesh material of low thermal conductivity and is thick enough so that the skin of an individual cannot touch the wall of the freezer. The mesh has openings in it to allow air to circulate through it and therefore not adversely affect the efficiency of the freezer.

BRIEF DESCRIPTION OF THE DRAWING

FIG. 1 is a perspective view of a typical freezer with some parts exploded and some parts cut away so as to illustrate the principles of the invention;

FIG. 2 is a perspective view of a mesh liner unit constructed according to the principles of the invention;

FIG. 3 is an enlarged view of a portion of the mesh to illustrate construction of the mesh;

FIG. 4 is a view similar to FIG. 3 but showing a different configuration for the mesh liner; and FIG. 5 is a view similar to FIGS. 3 and 4 and showing yet another pattern for the mesh liner.

DESCRIPTION OF THE PREFERRED EMBODIMENT OF THE INVENTION

FIG. 1 shows a portion of a typical freezer or freezer compartment which has walls 10 that form an enclosure for containing the items within the freezer compartment. Although not shown, it is well known that the freezer compartment would also have a bottom wall and sometimes a top wall or removable cover, none of which are shown for purposes of simplicity. In any event, it is well understood that the freezer provides for one of the walls or top being openable to provide access to the interior of the freezer.

Each wall 10 has an outer surface 12 separated by insulation 14 from an inner surface 16. The inner surface 16 of the walls 10 typically is of a material, such as metal, which has a high thermal conductivity and a sufficient heat-sink ability to freeze liquid that would come in contact with it. FIG. 1 illustrates the principles of the invention in which there are positioned along the inside surfaces 16 one or more protective shields indicated generally by the reference numeral 18. Each of the protective shields 18 of the invention is comprised of a main supporting frame 20 preferably rectangular in shape. Secured to the supporting frame 20 in any suitable manner is a sheet of mesh 22. If desired and if necessary, intermediate supports 24 can extend between the main supporting frame 20. The intermediate supports 24 allow air flow through and behind the protective shields 18 and may be in a pleasing pattern—circular or diamond shaped, the latter being shown in the drawings. Also, the intermediate supports 24 may be of varying thicknesses such as along the edges and center to provide additional strength and rigidity and greater separation from the freezer surface.

Each protective shield 18 has supporting legs 26. The supporting legs 26 provide for more easy removal of the protective shields 18 for cleaning and also serve to enhance the natural air flow. Although the legs 26 are not necessary for the proper functioning of the invention, they will keep the protective shields 18 above the floor of the freezer, and it is unlikely that the user would get his or her hands beneath the supporting frame 20.

Generally, more than one protective shield 18 will be necessary along each wall 10 of the freezer compartment. Where multiple protective shields 18 are required, adjoining shields can be held together by a double "U" shaped channel 28 that slides down between the shields. In the alternative, single "U" shaped channels 30 can be positioned along the top of the supporting frame 20 with corner pieces 32 used to connect the protective shields 18 where they meet at the corners of the freezer compartment.

The mesh 22 may be of any thickness, size and stiffness that minimizes the likelihood of a person touching the inner surface 16 of the freezer wall 10. As clearly shown in the drawings, the mesh 22 has openings which are sufficiently small and thick enough so that a person cannot insert the end of a finger through the mesh 22 and contact the inner surface 16 of the wall 10. However, the mesh openings allow air to freely circulate through the protective shields 18 so that the contents of the freezer can be properly cooled. The mesh 22 is made of any material having a low thermal conductivity, such as a plastic or polymer material. The mesh 22 may be rigid or it may be flexible, and it may have a pattern of openings of different configurations. FIGS. 1, 2 and 3 show the mesh 22 to have rectangular shaped openings, while FIG. 4 shows circular openings and FIG. 5 shows diamond shaped openings. The openings in the mesh 22 are preferably equally spaced to provide an attractive appearance.

With the protective shields 18 of the invention installed to completely cover all the inner surfaces 16 of the freezer compartment, it is virtually impossible for a person using the freezer to come in contact with any inner surface 16 and become injured. The shields 18 are made in a convenient size and are easily removable for cleaning. They are light weight and can be manufactured from relatively inexpensive materials. Because of their design with multiple openings that allow free circulation of air, the shields 18 do not materially interfere with the optimum efficiency of the freezer itself.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A freezer compartment having a removable protective liner for a freezer, said freezer compartment comprising: side and bottom freezer walls defining the freezer compartment, which walls are maintained at temperatures below freezing during operation of the freezer; a removable protective liner positioned inside the freezer compartment along one or more of the freezer walls to be protected so as to substantially cover the wall; a supporting frame for the liner; and a mesh material of low thermal conductivity supported by the supporting frame so as to be spaced from the freezer wall to protect an individual using the freezer from touching the freezer wall in the area where the liner is in place along the wall, the mesh material having one or more openings to allow air to circulate through the liner to and from the freezer walls so as not to adversely affect the efficiency of the freezer.

2. The freezer compartment of claim 1 in which the supporting frame has intermediate supports to provide additional strength and rigidity to the mesh material.

3. The freezer compartment of claim 1 in which the openings in the mesh material are small enough to prevent an individual's fingers from extending through an opening and touching a freezer wall.

4. The freezer compartment of claim 1 in which the mesh material is flexible.

5. The freezer compartment of claim 1 in which the mesh material is rigid.

6. The freezer compartment of claim 3 in which the openings are of substantially the same size and are uniformly spaced apart.

7. The freezer compartment of claim 1 which the supporting frame has legs to support the liner above the bottom freezer wall of the freezer compartment.

* * * * *